US005866206A

United States Patent [19]

Jennings-Tolchiner

[11] Patent Number: 5,866,206

[45] Date of Patent: Feb. 2, 1999

[54] DECORATIVE PAINTING APPARATUS AND METHOD

[76] Inventor: Barbara Jennings-Tolchiner, 14390 Fourth Ave. N, Plymouth, Minn. 55447

[21] Appl. No.: 925,948

[22] Filed: Sep. 8, 1997

[51] Int. Cl.[6] ..... B05D 1/38; B05D 3/12; B05D 1/28

[52] U.S. Cl. ..... 427/261; 427/256; 427/258; 427/259; 427/260; 427/262; 427/263; 427/267; 427/274; 427/280; 427/281; 427/402; 427/355; 427/429; 427/368

[58] Field of Search ..... 427/260, 259, 427/263, 268, 281, 368, 429, 402, 262, 267, 274, 280, 355; 118/264; 15/104.94, 107, 229.12, 229.13, 215; 428/913.3, 207, 15; 434/84

[56] References Cited

U.S. PATENT DOCUMENTS

| | | | |
|---|---|---|---|
| 1,029,077 | 6/1912 | Metzger | 15/107 |
| 4,317,847 | 3/1982 | Batistelli | 427/260 |
| 4,856,136 | 8/1989 | Janssen | 15/244.3 |
| 4,868,018 | 9/1989 | Schiffer | 428/15 |
| 4,919,975 | 4/1990 | Jones | 427/260 |
| 4,975,303 | 12/1990 | McKinnon | 427/263 |
| 5,348,767 | 9/1994 | Sandor | 427/273 |
| 5,639,513 | 6/1997 | Latham | 427/263 |

*Primary Examiner*—Shrive Beck
*Assistant Examiner*—Michael Barr
*Attorney, Agent, or Firm*—Nawrocki, Rooney & Sivertson, P.A.

[57] ABSTRACT

Apparatus, kit and method for painting a marbleized pattern on an essentially flat interior surface using paints with a plurality of colors. Before beginning the process, if necessary, the surface is cleaned and prepared. This can include applying masking tape around the periphery of the area to be painted. Splotches of paint of one color are then applied to a portion of the total area to be painted using a stiff bristled brush. Splotches of other paint colors are then applied interspersed with the previous colors. The brush is then used to preliminarily blend the various splotches of paint. A special blending tool faced with wool is used to complete blending the paint. The wool face is moistened before use, and blending is completed by patting the paint with the wool face of the tool while changing the angles and locations of the tool between each contact. Accent veining lines can be added to the blended paint surface using a feather dipped into a paint of a different color than the blended surface.

4 Claims, 6 Drawing Sheets

DECORATIVE PAINTING APPARATUS AND METHOD

BACKGROUND OF THE INVENTION

1. Field of the Invention

This invention relates to an apparatus, and a method of applying color media to any paintable surface, particularly walls, to create multiple decorative painted effects in an unprecedented fast and easy manner.

2. Description of the Prior Art

Faux finish is an art form of illusion achieved through an act of painting or a particular form of decorative painting. Traditional faux finishes are accomplished utilizing highly skilled and artistic decorative techniques. These techniques were designed to replicate many natural surfaces, such as granite, marble, aged European stucco, and suede. Typically, such known techniques have been used to decorate interior surfaces that would otherwise be impossible to manufacture or install with natural materials because of the shape of the surface or the extreme expense. Today, the faux finish process is used because it overcomes these problems and also permits utilizing colors which harmonize with other interior elements.

In the past, faux finish techniques required specialized paints, solvents, coloring agents, brushes, sponges, and other specialized elements. In addition, the finish was applied in a multi-step process involving several layers which required highly skilled craftsmen, typically requiring several days.

The traditional faux finish methods allow the artisan to work with several layers of thinned, translucent paints, called glazes, applied on top of an opaque base coat. Every color represents a separate layer which applied on top of the previously dried layers, making this a painstakingly complex and difficult process. A desirable factor to these techniques is the speed of application. If the artisan does not move fast enough or is delayed in the process, the work will be destroyed unavoidably due to the glazes drying before the work is finished.

Applying color media onto a surface in a two color pattern intended to resemble a marbleized finish has been taught in Jones, U.S. Pat. No. 4,919,975. Obtaining a painted finish on an exposed surface such as a wall or ceiling is taught by that document. The approach of Jones has a number of disadvantages including a limited number of options to create different effects, it requires a base coat, incorporates a limiting two colors that requires an applicator tool for each color used, it requires another tool and step to "fill-in" areas, requires a step of stamping the applicators together, and it incorporates another step of going over dry painted surface to reblend irregularly painted areas that result in many time consuming steps.

SUMMARY OF THE INVENTION

This invention provides an apparatus and a method of creating several painted faux finish effects using a plurality of contrasting colors in a single coat application. It is intended for any paintable surface, however interior walls are the primary focused surface. The method uses a plurality of contrasting colored paints which define the faux finish. While two to ten paint colors can be used in this method, the use of two to six is recommended for the novice. The apparatus and the method is specifically designed to reduce the complex, multi-layer process of traditional faux finishing, eliminate the base coat step, and eliminate the need to incorporate additional steps of blending corners and edges with the overall surface appearance. Prior to initiating the steps to acquire the subject method, standard surface preparation may be required prior to painting, a universal process necessary prior to any type of painting (such as wall repair work), removal of wallcovering paste residue or anything that would affect the adherence of paint to the surface. Uniform sheen is important by making sure that a preexisting coat of primer exists on the entire surface. Protective 2" masking tape can be applied to the adjoining woodwork and ceiling prior to painting and drop cloths should be used to protect the flooring.

As mentioned earlier, no prior base coat of paint is required to use this method. The patterns of this faux finish are produced using different color water compatible paints, i.e. a paint which can be diluted by water. A small amount of water dilution allows the user to create the illusion of texture without adding undesirable and unnecessary texture to the surface when it is dry. Latex paints provide a representative type paint which can be diluted by water.

In this method, adjacent portions of essentially uniform width extending from edge to edge across the area to be painted are selected, in turn, for painting. The paint can be applied and blended to selected portions approximately five feet in width and four to five feet in height. During the blending process, each newly painted portion is blended with the edges of adjacent previously painted portions. After the first portion has been processed, adjacent portions are selected, painted and blended in the same manner until the entire area to be painted has been covered. Previously painted portions can be dry or wet when blending the new portions with them. The nature of the apparatus, method and the consistency of the paint allows this to be possible.

Each color paint is applied in heavy splotches using a very large (i.e., 6") paint brush. The paint should be applied so heavily, that it will sometimes drip. Appropriate spacing should be left between splotches according to the number of subsequent colors to be used, i.e. if using more paint colors, space splotches further apart, if using fewer paint colors, space splotches closer together. After splotches of the first color paint are applied, splotches of each subsequent contrasting color are applied to the surface until all of the desired colors are applied to the surface area using the same brush. From two to ten colors can be applied in this manner until the entire selected portion has splotches evenly dispersed.

After all the colors have been applied to a selected portion, a preliminary blending of paints is accomplished using the same brush while each color of paint is still wet. This consists of brushing over all the splotches and areas between the splotches to spread the paint evenly across the selected portion of the surface and spread any possible paint drips. This also includes spreading the paint into the outer edge of adjacent previously painted portions, edges or corners.

After preliminary blending, the blending process is completed by using a special hand-held blending tool which has a wool facing. Blending is completed by patting the painted surface with the wool facing and into adjacent portions, ceiling line, woodwork line, or corners, therefore avoiding any unnecessary tools or steps to complete the edges. The edges of adjacent previously painted areas are also blended with the current selection portion to create an attractive unidentifiable transition of color.

When two-step blending the paints, if a slight amount of blending is done, the highly textured effect of granite is created. If blending is continued considerably more, the effect of aged European stucco is created. A great amount of blending will create a soft transition of colors found in suede.

In another version, the paint splotches are applied in a diagonal pattern by applying the first color in diagonal splotches, followed by applying the subsequent colors in diagonal splotches using a large brush.

After all the colors have been applied to a selected portion, preliminary blending of the paints is accomplished using the same brush. This preliminary blending consists of brushing over the diagonal splotches and area between the splotches, including brushing into the outer edge of previously painted adjacent portions as well as corners and edges adjacent to selection portion.

The blending process is completed, by patting the painted surface with the blending tool, with the wool facing, producing a completely blended surface to desired effect. The patting of the blending tool with surface creates the desired transitions of color and illusionary texture without undesired repeating imprint patterns shaped like blending tool. The boundaries of painted portions adjacent to previously painted portions are lightly blended to create an attractive transition and flow.

After all of the diagonal portions of the complete surface to be painted have been painted, blended, and allowed to dry, accent marble veins can be painted over the dried paint. Accent marble veins are created by dipping a large feather into paint mixed with a considerable amount of water than that resulting from the blended paints and freehanding the desired accent line patterns. These accent lines can be made to resemble veins in genuine marble.

A dramatic effect can be provided after the complete surface has been painted and allowed to dry by attaching a number of equally spaced tapes to the surface extending generally perpendicular to opposed edges. For vertically extending surfaces, these tapes will also be oriented vertically and extend between the top and the bottom edge of the painted surface. These tapes define a plurality of adjacent parallel areas. Alternate parallel areas are then painted by the large brush with a paint which contrasts with the previously blended paints, and then blended by brush and then by the blending tool as before. After the paint applied to the alternate areas has dried the tape is removed. The previously blended parallel areas, interspersed with the contrasting blended paint, provide a dramatic effect. The amount of contrast between the two can be varied by changing the color of paint, which also changes the emphasis.

BRIEF DESCRIPTION OF THE DRAWINGS

Objects of the prevent invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE INVENTION

Figure 8:
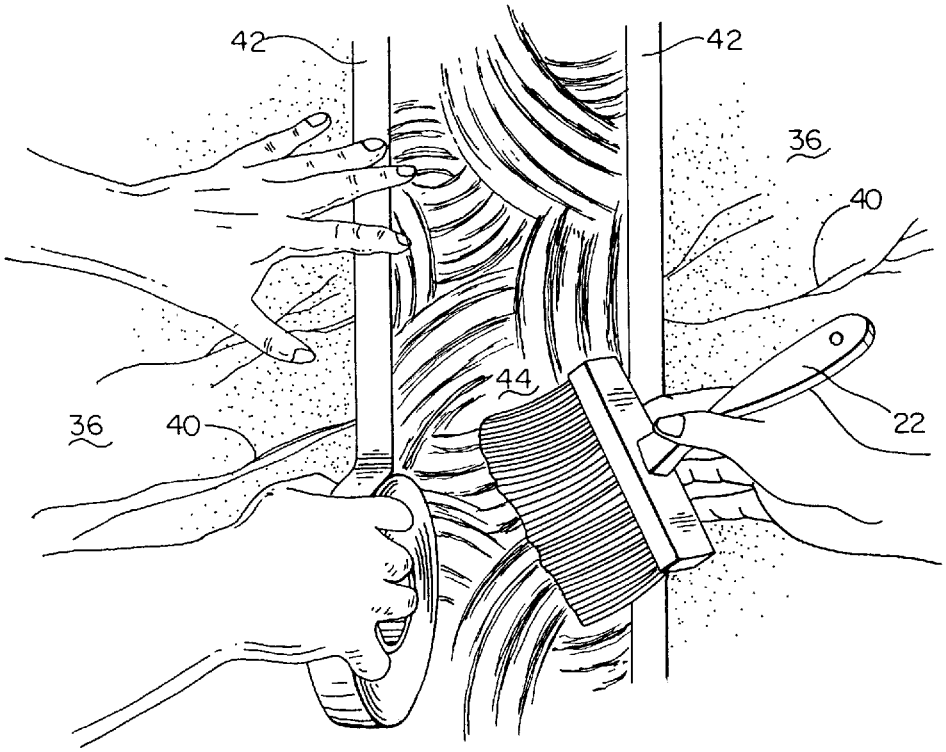
FIG. 8 shows the dried paint of FIG. 3 being divided into parallel areas by applying tape and one of the parallel areas being painted and blended by brush.

The present invention relates to an apparatus and a method of producing several decorative painted faux finishes on any paintable surface, particularly on walls, using a number of contrasting paint colors, but with no new base coat required, in an efficient, consistent, fast, and aesthetically pleasing manner. Blending tool 10 is shown in FIG. 8. Tool 10 was specifically designed for this use, and is required to complete the blending process. Tool 10 has a body 12 of plastic formed into a generally planar, rectangular shape with a handle 14 formed in the center. Wool 16, which consists of wool with its skin, is attached to the face of body 16 to provide the facing. Wool 16 covers the face of body 10 opposite handle 14 and extends around the sides of the body to allow for efficient edge and corner painting. Wool 16 is secured to the handle side of the body with the skin innermost and the wool outermost.

The paint used here is a water compatible paint, such as a latex paint, to permit slight dilution by water. This permits slight diluting of the paints to a thickness that will provide the best results. A plurality of contrasting paints of two to ten in number can be used. Prior to this process, standard paint preparation may be required. This may include such things as removing any previous coverings and adhesive, filling and spot priming any holes and sanding any glossy surfaces to provide a sound surface of uniform sheen. Such priming is required only when the prepared surface would otherwise be nonuniform in appearance. For new surfaces, initial prime coating is necessary as with any type of painting. Protective 2" masking tape is applied to the adjacent woodwork and ceiling of the surface and drop cloths used to cover flooring.

The total area to be painted is processed as a plurality of selected portions of essentially equal width extending from edge to edge perpendicularly across the surface to be painted. When the painted surface is vertical, the total area will be processed in sequence in a plurality of generally equal width vertical portions extending from the top to the bottom of the areas to be painted. A portion is selected and processed, a second portion adjacent to the first portion selected area is selected and processed, a third portion adjacent to either the first or second processed portion is then selected and processed until all of the portions making up the entire surface have been processed.

In this description only three paints are used, however, the process remains the same regardless of the number used.

Figure 1:
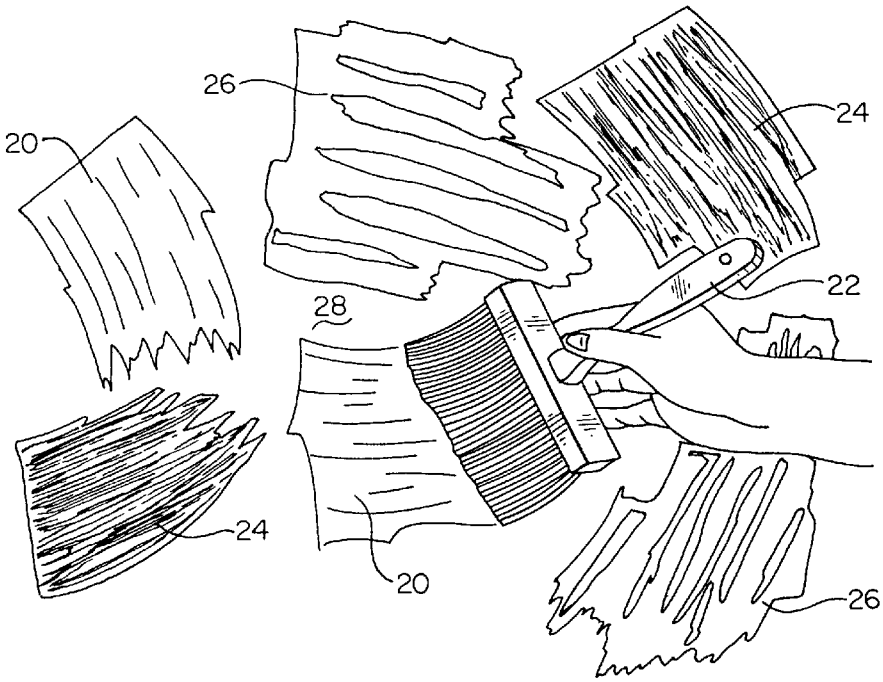
FIG. 1 is a front view of a surface to be painted showing the application of interspersed splotches of different paints by a brush.

After the paints have been slightly diluted with water, the process is begun in the step shown in FIG. 1, by applying the first color in separate splotches 20 followed by applying the next color in splotches 24, and third color 26, using a large brush 22. After this step splotches 20 and 24 and 26 consume substantially all of the selected portion 28 of the entire area to be painted, with splotches 20, 24 and 26 each covering essentially equal areas of the selected portion.

Figure 2:
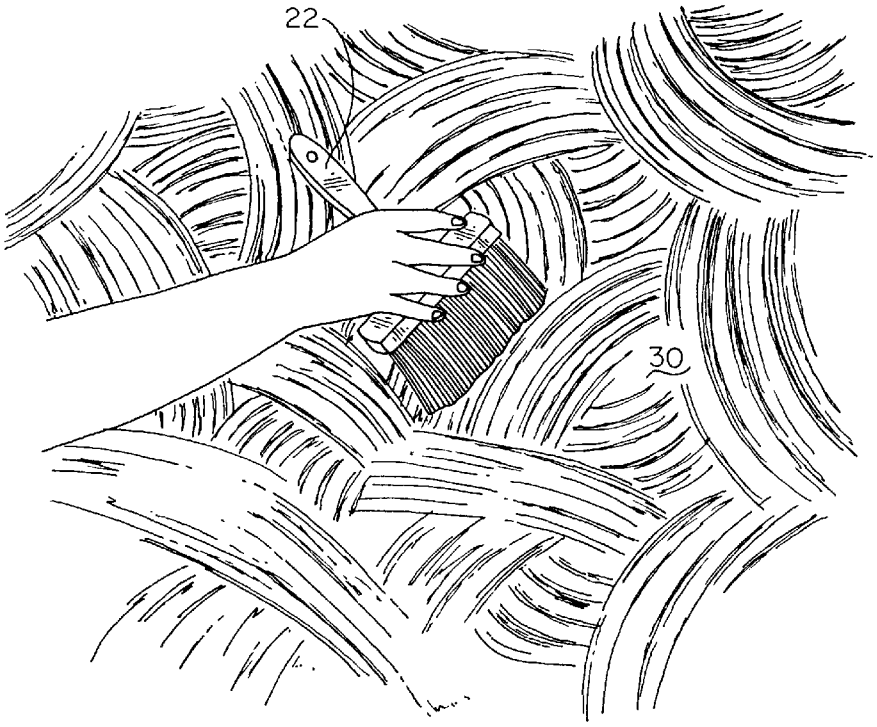
FIG. 2 shows the applied splotches of paints of FIG. 1 being blended with a brush.

After all the colors have been applied to a selected portion, the next step, a preliminary blending of the paints 30, as shown in FIG. 2, is accomplished using the same brush 22. This preliminary blending consists of brushing over the splotches and area between the splotches also to include brushing into the outer edge of any previously painted adjacent portions as well as corners and edges adjacent to selected portion.

Figure 3:
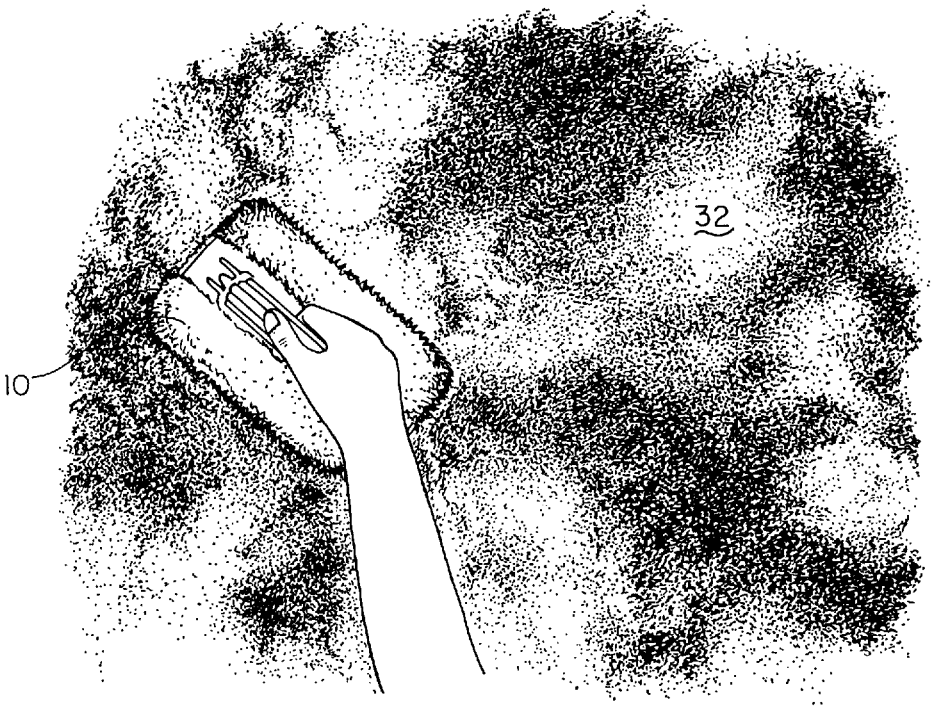
FIG. 3 shows the completion of blending the splotches of paints of FIG. 2 using a blending tool.
Figure 12:
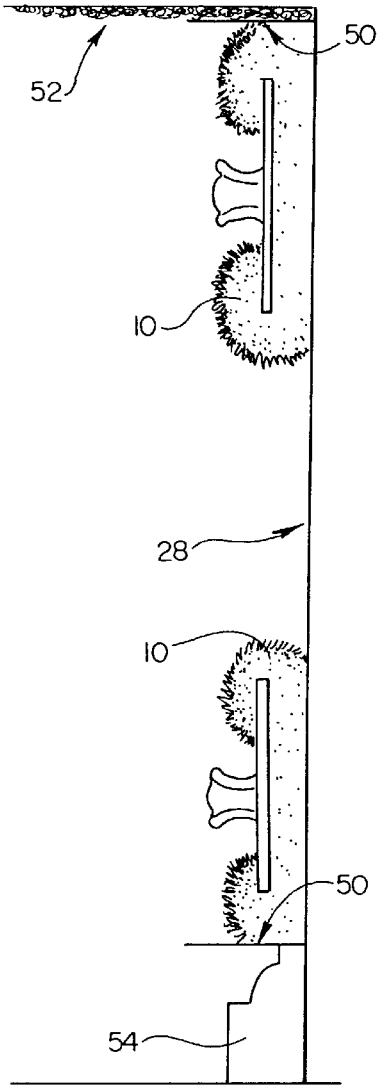
FIG. 12 shows the special blending tool blending evenly along the ceiling and woodwork lines to alleviate additional tools.

The blending process is completed, as shown in FIG. 3, by patting the painted surface with blending tool 10, with the wool facing 16, producing a completely blended surface to desired look 32. The patting of the blending tool 10 with surface 32 creates the desired transition of colors and illusionary texture without undesired repeating imprint patterns shaped like blending tool 10. The boundaries of painted portions adjacent to previously painted portions are lightly blended to create a consistent transition and flow. In FIG. 12, adjacent ceiling line 52 and woodwork line 54 are protected with 2" masking tape 50 to allow blending tool 10 to evenly and consistently decoratively paint. The user will immediately learn how much blending is necessary to acquire their desired effect with little practice.

After the first selected portion has been painted and blended using the two-step process described above, an adjacent portion is then selected, painted and two-step blended in the same manner. All of the remaining portions are selected, painted and two-step blended in turn in the same manner until the entire area to be painted has been covered. An advantage of using opaque latex type paint instead of transparent glazes is that one portion can be painted, blended and if necessary, allowed to dry before an adjacent area is painted and blended in with the dry paint of the previously painted portion with no inconsistencies in the final result.

When blending the paints, if a slight amount of blending is done, the highly textured effect of granite is created. If blending is continued considerably, the slightly textured effect of aged European stucco is created. A great amount of blending will create the mildly textured soft transition of color found in the appearance of suede.

Figure 4:
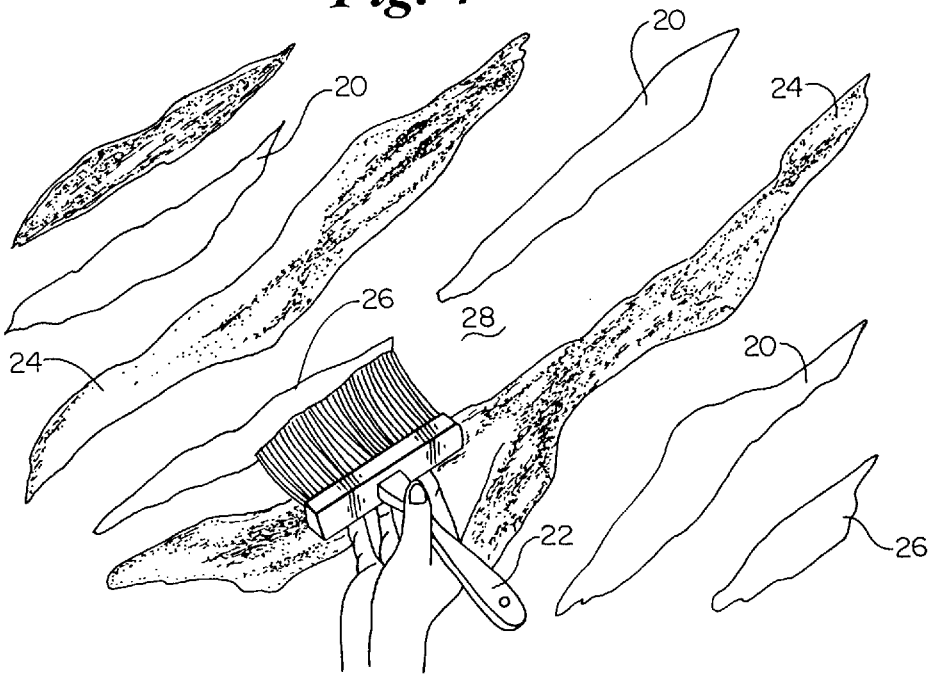
FIG. 4 is a view of a surface to be painted showing the application of diagonal splotches of different paints by a brush.

In another version, the paint splotches are applied in a diagonal pattern as shown in FIG. 4, by applying the first color in diagonal splotches 20 followed by applying the next color in diagonal splotches 24, and third color 26, using a large brush 22. After this step, diagonal splotches 20 and 24 and 26 consume substantially all of the selected portion 28 of the entire area to be painted, with diagonal splotches 20, 24 and 26 each covering the selected portion.

Figure 5:
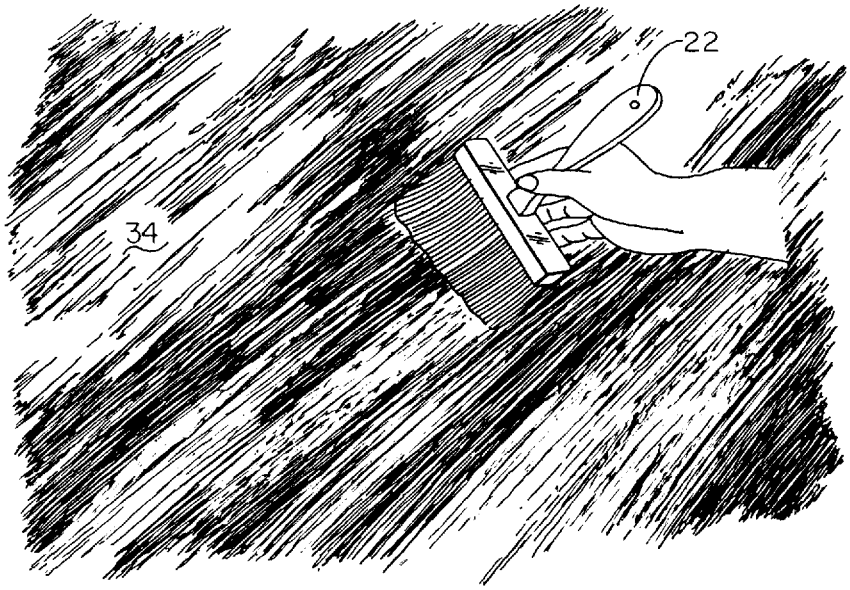
FIG. 5 shows the applied diagonal splotches of paints of FIG. 4 being blended with a brush.

After all the colors have been applied to a selected portion in a diagonal pattern, the next step, a preliminary blending of the paints 34, as shown in FIG. 5, is accomplished using the same brush 22. This preliminary blending consists of brushing over the diagonal splotches and area between the splotches also including brushing into the outer edge of any previously painted adjacent portions as well as corners and edges adjacent to selected portion.

Figure 6:
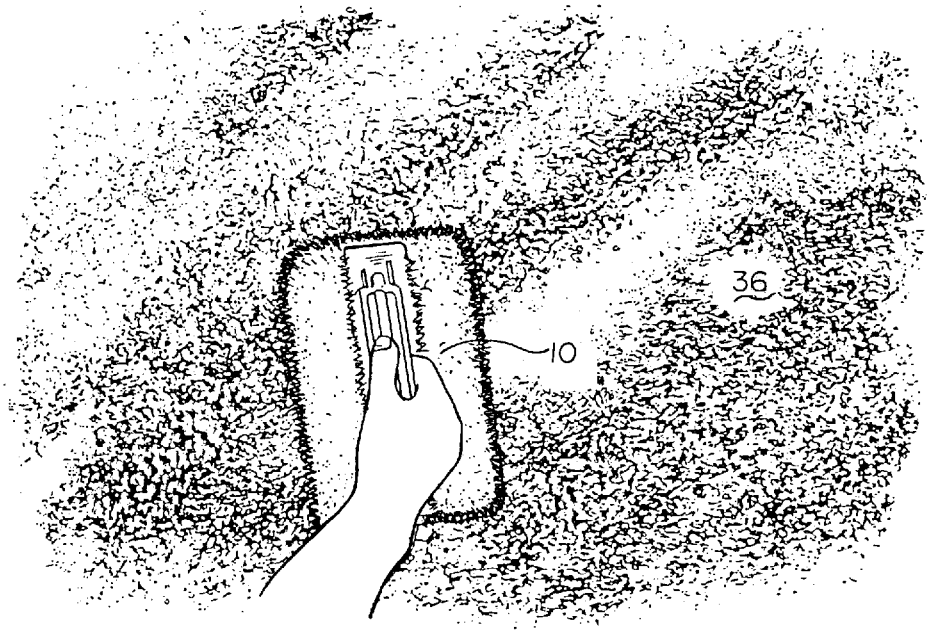
FIG. 6 shows the completion of blending the diagonal splotches of paints of FIG. 5 using the blending tool.

The blending process is completed, as shown in FIG. 6, by patting the painted surface with blending tool 10, with the wool facing 16, producing a completely blended surface to desired look 36. The patting of the blending tool 10 with surface 36 creates the desired transitions of colors and illusionary texture without undesired repeating imprint patterns shaped like blending tool 10. The boundaries of painted portions adjacent to previously painted portions, edges and corners are lightly blended to create a consistent transition and flow.

Figure 7:
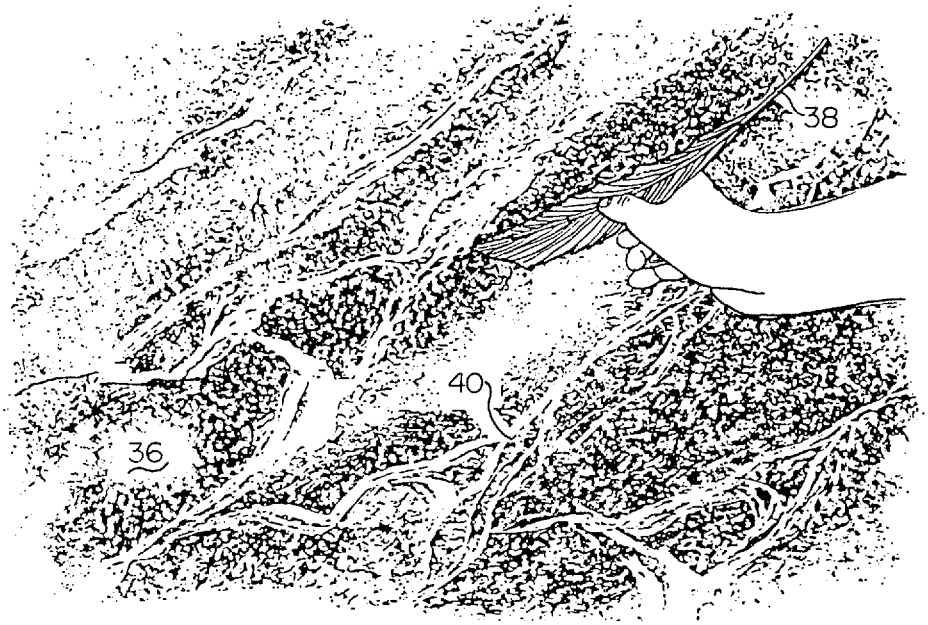
FIG. 7 shows the paint of FIG. 6 after drying being veined using a feather applicator.

After the entire area to be processed has been diagonally painted, two-step blended, and surfaces 36 have dried, a large feather 38, dipped in paint diluted with a considerable amount of water which contrasts with surfaces 36, can be used as shown in FIG. 7 to freehand the appearance of marble veins 40 or leather creases on the surface. Practice with the feather will result in a close mimic to actual veins in marble which greatly enhance the results.

Another version, after the entire area to be processed has been painted, two-step blended and surfaces 36 have dried, a dramatic effect can be provided by first attaching a number of equally spaced and parallel tapes 42 to the surface, as shown in FIG. 8. Tapes 42 are shown being applied which extend across surface 36 generally perpendicular to opposed edges. These tapes define a plurality of adjacent parallel areas across the entire area which was painted. When the surface is vertical the tapes will also be vertical dividing the surface into a plurality of essentially equal width parallel stripes defining parallel areas running between the upper and lower edges.

Figure 9:
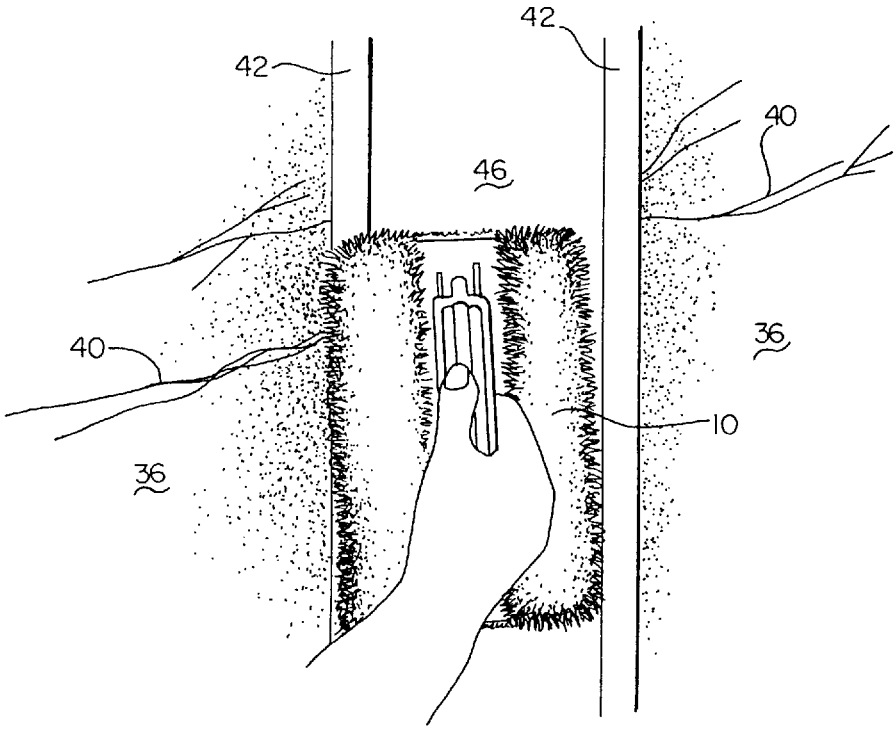
FIG. 9 shows the area of FIG. 8 after being brush blended being completely blended by the blending tool.

As also shown in FIG. 8, a parallel area 44 is being painted and then blended using brush 22 over the parallel area using paint which contrast with the previously blended paints. The parallel areas 44 of FIG. 8 are then blended using blending tool 10 as described earlier producing a completely blended surface 46, as shown in FIG. 9.

The process described above illustrated by FIGS. 8 and 9 using brush 22 and blending tool 10 is repeated for alternating parallel areas 44 over the entire previously painted surface.

Figure 10:
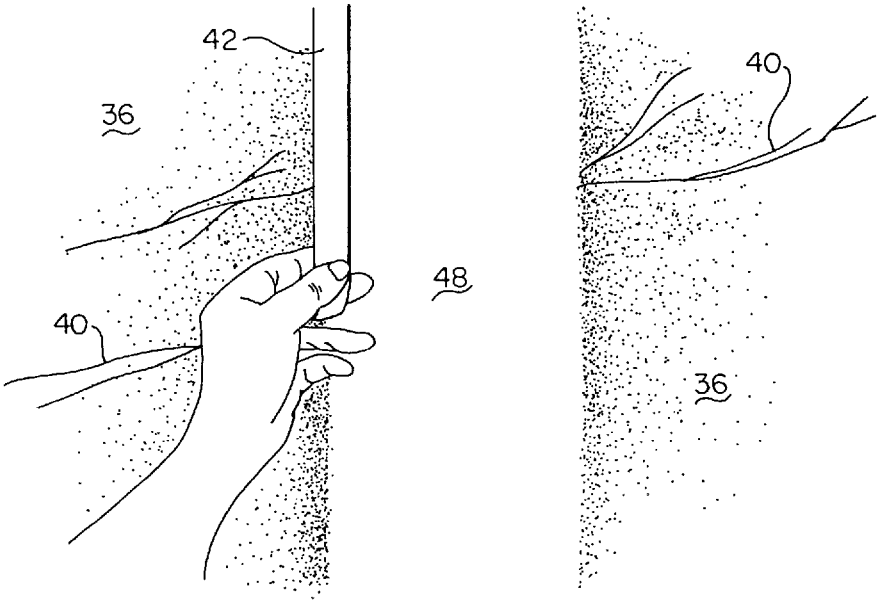
FIG. 10 shows the masking tape being removed from FIG. 9.
Figure 11:
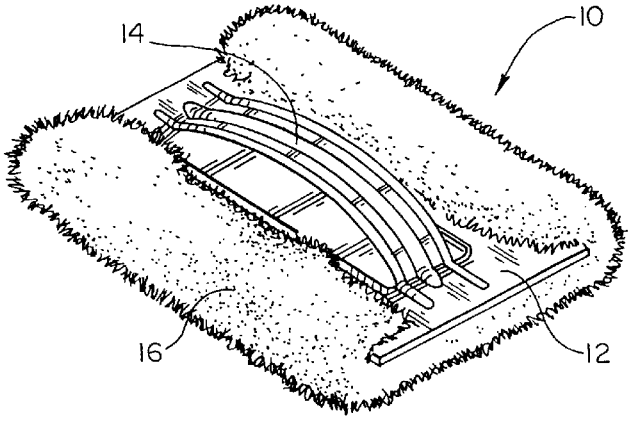
FIG. 11 shows an isometric view of the special blending tool.

After surface 46 has dried, tape 42 is removed as shown in FIG. 10 resulting in surface 48 over the entire previously painted surface. The previously blended areas 36 are interspersed with the contrasting paint of areas 48 which provide a dramatic effect. The amount of contrast between the two areas can be varied by changing the paint contrasts to change the amount of emphasis. This method produces a faux "fantasy finish" with no base coat required. The new blending tool enhances the faux finish effect greatly with the minimum of effort and with the minimum of training.

Creating authentic surface replications through faux finish decorative painting is easy to learn and to accomplish using this apparatus and method.

While this invention has been described with reference to illustrative embodiments, these descriptions are not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

What is claimed is:

1. A method of producing a painted faux finish on a surface having at least two opposed edges, comprising the steps of:

(a) providing:

i) at least two separate paints of different colors;

ii) a brush;

iii) a blending tool having:

a body with a generally planar first surface opposite a second surface;

a handle secured to, and projecting outwardly from, the second surface of the body; and a wool material having a wool surface and a flexible backing, said backing overlying said first surface such that the wool surface is exposed;

iv) masking tape; and v) an additional color paint contrasting with a color resulting from application and blending of paints as defined in steps (d)–(f) hereafter;

(b) mixing a quantity of water into each color of paint;

(c) selecting a portion of the total area to be painted having a substantially uniform dimension extending between the opposed edges, and thereafter identifying a subsequent portion adjacent a portion painted previously in accordance with steps (d)–(f) defined hereafter;

(d) applying in turn a plurality of splotches of paint provided in accordance with step (a)i), each of said splotches separate from all other said splotches, of each color of paint by brush over the selected portion;

(e) moistening the wool surface of the wool material of said blending tool;

(f) blending all the splotches of paint applied in accordance with step (d) in the selected portion and in an outermost edge of any previously painted adjacent portion to produce a faux finish by patting the surface of the portions with the wool surface of the wool material of said blending tool;

(g) applying essentially parallel and equally spaced strips of masking tape to the total area painted such that said tapes extend between, and generally perpendicular to, the edges thereof such as to produce a plurality of defined parallel areas;

(h) re-painting every other defined parallel area by brush with the contrasting color paint provided in accordance with step (a)v);

(i) blending the re-painted areas by patting the surface of the re-painted areas with the wool surface of the wool material of the blending tool while simultaneously varying the tool angle and position of said tool between successive contacts using the blending tool;

(j) allowing the re-painted areas to dry; and (k) removing the parallel strips of masking tape.

2. The method of claim 1 further including performing, before step (a), a step of:

applying masking tape around the periphery of the area to be painted; and performing, after step (f) a step of:

removing the peripheral masking tape.

3. The method of claim 1 wherein step (a)i) includes providing paint of a contrasting color than the resulting color of the applied and blended paints, and wherein after step (f), the method further includes the step of:

applying the contrasting color paint using a feather so as to produce the appearance of marble veining.

4. The method of claim 1, further performing a step of:

blending paint proximate edges and corners formed by intersections of the surface with previously painted adjacent portions by patting the surface of the portions of the wool surface of the wool material of said blending tool against the surface to be painted with an edge of said blending tool closely proximate, and generally parallel to, a line of intersection of the surface to be painted with an adjacent portion.

* * * * *